US005317493A

United States Patent [19]

Muller et al.

[11] Patent Number: 5,317,493

[45] Date of Patent: May 31, 1994

[54] APPARATUS FOR INSTALLING LIGHTING FIXTURE ASSEMBLIES FROM INCLINED PLANAR SURFACES

[75] Inventors: Henry P. Muller, Forest Hills, N.Y.; Stanley Arasim, West Mildford, N.J.

[73] Assignee: Lightolier Division of the Genlyte Group, Inc., Secaucus, N.J.

[21] Appl. No.: 725,018

[22] Filed: Jul. 3, 1991

[51] Int. Cl.[5] ..... F21S 1/02

[52] U.S. Cl. ..... 362/407; 362/403; 362/404; 362/430

[58] Field of Search ..... 362/391, 401, 403, 404, 362/427, 430, 407, 408, 147, 421, 382, 457

[56] References Cited

U.S. PATENT DOCUMENTS

| | | | |
|---|---|---|---|
| 393,126 | 11/1888 | Smart . | |
| 394,680 | 12/1888 | Dawes . | |
| 684,264 | 10/1901 | Kemmerer . | |
| 866,473 | 9/1907 | Smith | 362/391 |
| 1,127,527 | 2/1915 | Schoen | 362/404 |
| 1,137,906 | 5/1915 | Rosenberg . | |
| 1,501,524 | 7/1924 | Cousins | 362/408 |
| 1,631,488 | 6/1927 | Jones | 362/403 |
| 1,662,568 | 3/1928 | Foell | 362/407 |
| 1,704,626 | 3/1929 | Nero | 362/407 |
| 2,753,445 | 7/1956 | Thomas et al. | 362/404 |
| 2,762,598 | 9/1956 | Runge . | |
| 2,937,841 | 5/1960 | Bodian . | |
| 3,168,252 | 2/1965 | Cabernoch . | |
| 3,512,743 | 5/1970 | Lipscomb | 362/404 |
| 4,232,361 | 11/1980 | Kelsall | 362/404 |
| 4,473,873 | 9/1984 | Quiogue . | |
| 4,751,627 | 7/1988 | Usher . | |

FOREIGN PATENT DOCUMENTS

| | | | |
|---|---|---|---|
| 296671 | 2/1917 | Fed. Rep. of Germany | 362/457 |
| 379120 | 3/1933 | Fed. Rep. of Germany | 362/457 |
| 98426 | 4/1923 | Switzerland | 362/407 |
| 831436 | 3/1960 | United Kingdom | 362/404 |

*Primary Examiner*—Ira S. Lazarus
*Assistant Examiner*—Y. Quach
*Attorney, Agent, or Firm*—Hopgood, Calimafde, Kalil, Blaustein, & Judlowe

[57] ABSTRACT

An assembly is disclosed for mounting on an inclined planar surface, a light fixture suspended by at least one fixture suspension cable and provided with at least one power cord. In general, the mounting assembly comprises a mounting base, and first and second suspension means. The mounting base is for attachment to a planar structure disposed relative to a reference plane, and includes at least one power cord suspension aperture. The first suspension means is operably associated with the mounting base and is adapted for attachment to one end of the fixture cable. The second suspension means is mounted through the power cord suspension aperture and is adapted for attachment to a portion of the power cord. The first suspension means and the second suspension means each permit pivotal movement of the fixture suspension cable and the power cord, respectively, that is, relative to the mounting base, and the first suspension means and the second suspension means are operable independent of each other. In the illustrated embodiment, three first suspension means are operably associated with the mounting base, and each comprises fixture cable length adjustment means which permits simple adjustment in length of the fixture suspension cable with respect to the reference plane. Also the second suspension means comprises power cord length adjustment means which permits simple adjustment in length of the power cord with respect to the reference plane.

11 Claims, 4 Drawing Sheets

APPARATUS FOR INSTALLING LIGHTING FIXTURE ASSEMBLIES FROM INCLINED PLANAR SURFACES

BACKGROUND OF THE INVENTION

1. Field of Invention

The present invention relates generally to ceiling mounting devices for lighting fixture assemblies, and more particular to such devices which can adjustably mount lighting fixture assemblies to inclined surfaces of a varying range of inclination.

2. Brief Description of the Prior Art

A variety of prior art devices are known for installing a lighting fixture assembly to ceiling structures.

According to one type of prior art mounting device, a tubular arm is rotatably connected to a ceiling support base, to provide positional adjustment to an electrical lamp unit disposed at one end of the tubular arm, while electrical conductors extend therethrough. Representative examples of such prior art mounting devices are disclosed in U.S. Pat. Nos. 2,937,841 to Bodian; 2,762,598 to Rumge; 2,753,445 to Thomas, et al ; 1,137,906 to Rosenberg; 684,264 to Kemmerer; and 393,126 to Smart.

According to a second type of prior art mounting device, a tubular arm is rotatably connected to a ceiling support base, in order to provide positional adjustment to an electrical lamp unit disposed at the distal end of the tubular arm, while electrical power lines extend exteriorly of the tubular arm. Representative examples of such prior art mounting devices include U.S. Pat. Nos. 4,751,627 to Usher and 394,680 to Dawes.

While prior art ceiling mounting devices have had many desirable characteristics, such as permitting angular and rotational adjustment, such devices in general have not permitted independent angular and rotational adjustment of lighting fixture cables and power cords such that a drop-type lighting fixture assemblies can be suspended from an inclined ceiling surface in a simple, quick and convenient manner.

Accordingly, it is a primary object of the present invention to provide a ceiling mounting assembly for suspending a drop-type lighting fixture or luminaire assembly from an inclined ceiling surface, in a way which overcomes the shortcomings and drawbacks of prior art devices.

Another object of the present invention is to provide such a mounting device, in which each lighting fixture cable and power supply cord is permitted to undergo independent angular or rotational displacement to the vertical position in response to gravitational loading.

Another object of the present invention is to provide such a mounting device in which the length of each lighting fixture suspension cable and power supply cord can be independently adjusted in length so as to permit quick and simple leveling of a luminaire assembly independent of the inclination of the ceiling or fixture support surface.

An even further object of the present invention is to provide such a mounting device, in which after installation of the mounting assembly to the inclined ceiling and of the leveling lighting fixture, the length of the power supply cord can be simply adjusted in length in order to match the distance of the luminaire assembly from the ceiling.

These and other objects of the present invention will become apparent hereinafter.

SUMMARY OF INVENTION

According to one of the broader aspects of the present invention, an assembly is provided for mounting a light fixture which is suspended by at least one fixture suspension cable and provided with at least one power cord.

In general, the mounting assembly comprises a mounting base, and at least one first and second suspension means. The mounting base is for attachment to a planar structure disposed relative to a reference plane, and includes at least one power cord suspension aperture. The first suspension means is operably associated with the mounting base and is adapted for attachment to one end of a fixture suspension member, such as a fixture suspension cable, chain, rod, tube or rope. The second suspension means is mounted through the power cord suspension aperture and is adapted for releasable attachment to a selected portion the power cord. The first suspension means and the second suspension means each permit pivotal movement of the fixture suspension cable and the power cord, respectively, that is, relative to the mounting base, and the first suspension means and the second suspension means are operable independent of each other.

In the illustrated embodiments, the first suspension means comprises fixture cable length adjustment means which permits simple adjustment in length of the fixture suspension cable. Also the second suspension means comprises power cord length adjustment means which permits simple adjustment in length of the power cord.

As a result of the present invention, the first suspension means permits pivotal movement of the fixture suspension cable independent of the angle of inclination formed between the planar structure and the reference plane, while the second suspension means permits pivotal movement of the power cord independent of the angle of inclination.

Advantageously, this novel mounting arrangement permits improved mounting of drop-light lighting fixtures from inclined ceilings, by reducing stress on the power cord, permitting markedly simpler adjustment of fixture cable and power cord lengths, while enhancing the overall decorative features of the power cord and lighting fixture suspension cables.

DETAILED DESCRIPTION OF THE DRAWINGS

In order to provide a more complete description of the present invention, the Detailed Description of the Illustrative Embodiments is to be taken in connection with the following drawings, in which.

DETAILED DESCRIPTION OF THE PREFERRED EMBODIMENTS

Referring to FIGS. 1, 3, 4 and 5, the mounting assembly of the first embodiment of the present invention will be described.

Figure 1:
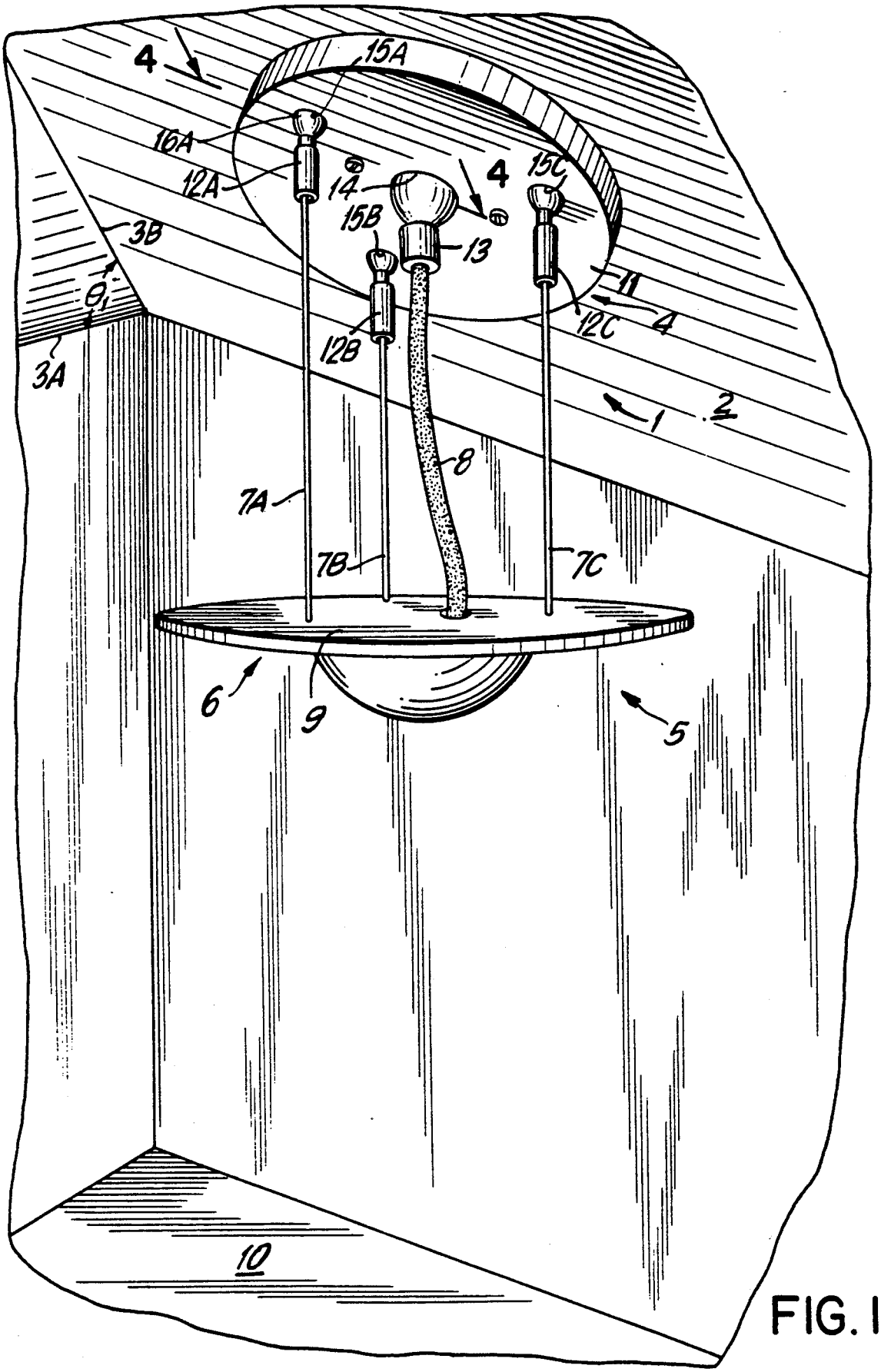
FIG. 1 is a perspective view of a lighting system of the present invention, showing a mounting assembly constructed according to a first embodiment of the present invention, and installed on an inclined ceiling, while the luminaire assembly (i.e. lighting fixture) is suspended in a level manner from three fixture suspension cables.

As illustrated in FIG. 1, lighting system 1 is installed on an inclined ceiling 2, which is disposed at an angle of inclination measured relative to a reference plane. In the illustrated embodiment, this plane is defined by the intersection of lines 3A and 3B. While the mounting surface can be virtually any planar surface, an inclined ceiling surface has been selected solely for purposes of illustration.

In general, lighting system 1 comprises mounting assembly 4 and a lighting fixture 5. In the illustrated embodiment, lighting fixture 5 includes luminaire assembly 6, three fixture suspension members (i.e., cables) 7A, 7B and 7C, and an electrical power cord 8. As illustrated, luminaire assembly 6 includes a decorative planar portion 9 which, when properly suspended, is essentially parallel to the floor surface 10 below the inclined ceiling surface. While the structure and shape of the luminaire assembly will vary from embodiment to embodiment, the need to level the luminaire assembly will invariably be present in nearly all applications.

As illustrated in FIG. 1, mounting assembly 4 includes a mounting base 11, three fixture cable suspension elements 12A, 12B and 12C, and a cord suspension element 13 operably associated with the mounting base in a manner which will be described in detail below. While the geometry of mounting base 11 generally resembles a disk, it may take on other forms in other embodiments without departing from the present invention.

Figure 2:
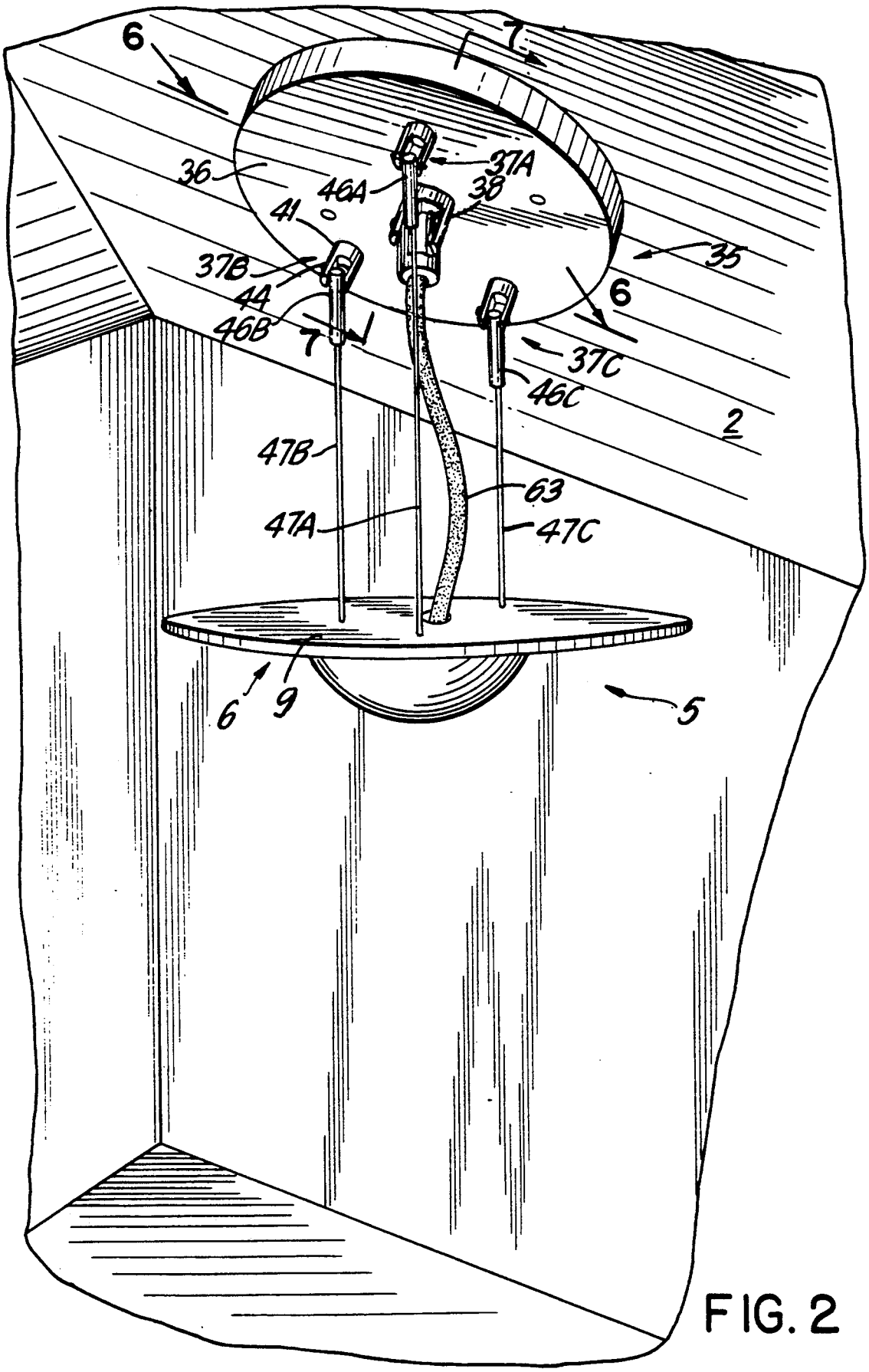
FIG. 2 is a perspective view of a lighting system of the present invention, showing a mounting assembly constructed according to a second embodiment of the present invention, and installed on an inclined ceiling, while the luminaire assembly is suspended in a level manner from three fixture suspension cables.

By referring to FIGS. 1 and 2 together, it can be seen that mounting base 11 is particularly adapted for attachment to a planar structure such as inclined ceiling 2, and includes a centrally formed circular aperture 14 and three circular apertures 15A, 15B and 15C disposed symmetrically about circular aperture 14. As will be described in greater detail hereinafter, aperture 14 functions as a power cord suspension aperture, whereas circular apertures 15A through 15C function as fixture cable suspension apertures.

As each fixture cable suspension element is identical, a detailed description thereof will be made in reference to fixture cable suspension element 12A, noting that similar components in the other suspension elements 12B and 12C will be indicated by like reference numerals.

As shown, fixture cable suspension elements 12A, 12B and 12C comprises a bearing structure 16A, 16B, and 16C, respectively each having an externally threaded body portion or post 17, and an adjustable collar 18 having a hollow core bearing internal threads adapted for threading over external threads on body portion 17. In order to suspend a fixture cable at one of its ends, each collar 18 has a bore 19 formed at its closed end for passage of the fixture cable. The terminal portion of this fixture cable can be simply inserted up into and along bore 19. Then, cable securing screw 20 can be screwed into threaded transverse bore 21 to engage and secure the terminal portion of the fixture suspension cable. In an alternative embodiment, the terminal end of the fixture cable can have a metal tip welded or crimped onto its end to form a structure which will restrain the cable from sliding through bore 19 in each adjusting collar. Fine adjustment of cable length can be achieved by simply rotating the adjustment collar relative to the threaded body portion.

Figure 4:
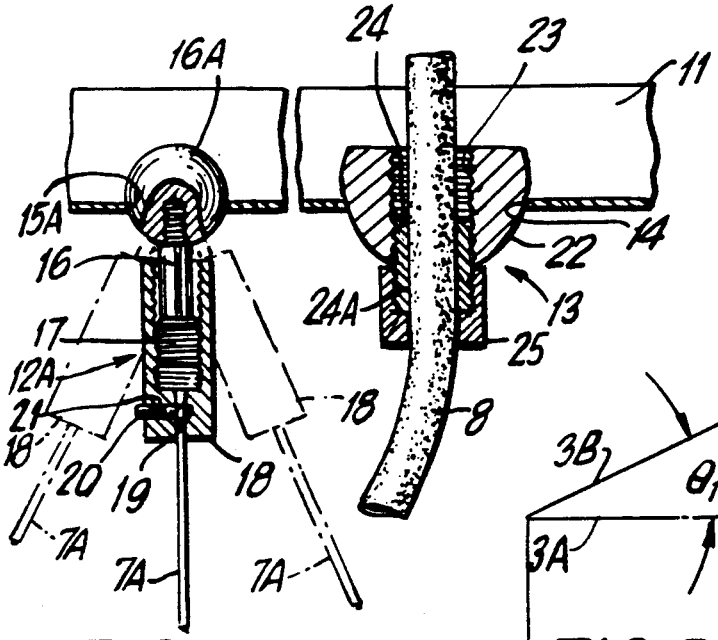
FIG. 4 is a cross-sectional view of the completely assembled mounting assembly taken along line 4—4 of FIG. 1.

As illustrated in FIG. 4, each bearing structure 16A, 16B, and 16C includes a spherical structure 21 which extends from one end of the body portion. Each spherical structure has a spherical surface which seats within its respective circular aperture 15A, 15B and 15C so as to permit each of the fixture cable suspension elements and attached fixture cable to undergo free swivel (e.g. pivotal) movement with respect to mounting base 11.

As illustrated, power cord suspension element 13 comprises a bearing structure 22 having a threaded bore 23 therethrough, which permits a hollow threaded sleeve 24 to screw into the threaded bore. This arrangement permits power cord 8 to pass through the central bore and to be releasably secured therewithin by a strain relief bushing 25 threaded upon a portion 24A of sleeve 24 projecting beyond bearing structure 22. In order to allow the power cord suspension element to swivel (i.e., undergo free pivotal movement) bearing structure 22 includes a spherical surface which seats within circular aperture 14. With this structural arrangement, the length of power cord extending through and beyond suspension aperture 14 can be simply adjusted by advancing or withdrawing the power cord through circular aperture 14 and then by securing the selected length tightening strain relief collar 25 onto sleeve 24.

Figure 3:
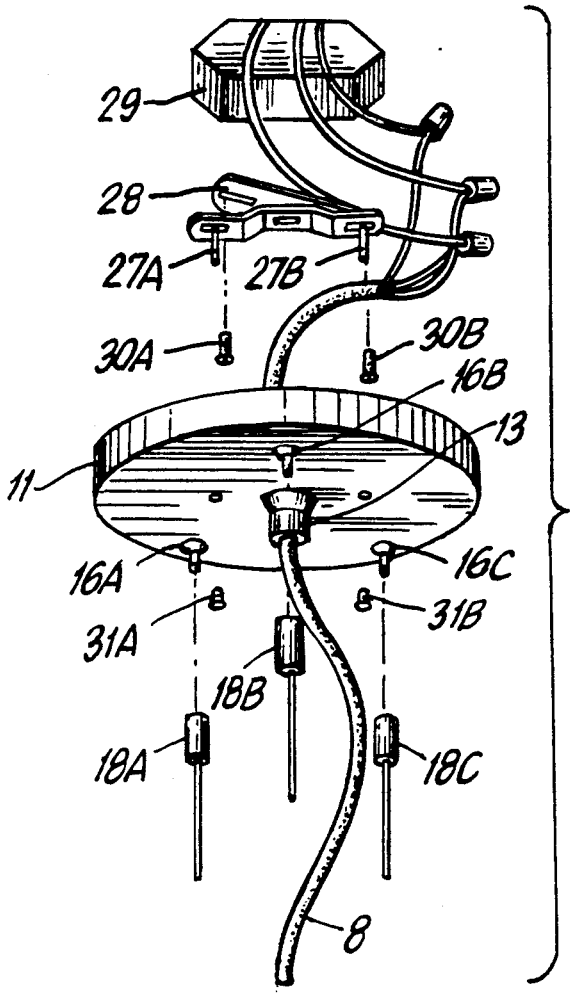
FIG. 3 is a partially exploded perspective view of the mounting assembly of FIG. 1, shown operably associated with electrical wires extending from a conventional utility box.
Figure 5:
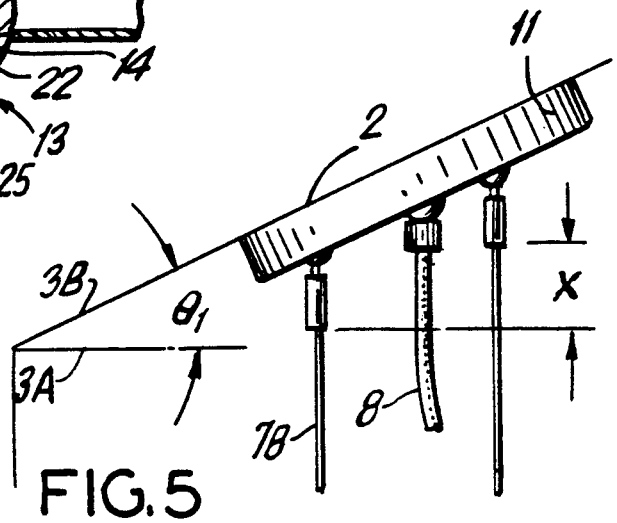
FIG. 5 is a schematic illustration of the mounting assembly of FIG. 1, shown mounted to the inclined ceiling surface having a predetermined angle of inclination.

Referring to FIGS. 3 and 5, the preferred method of installing the mounting assembly of the first embodiment, will now be described.

The first step of the method involves threading mounting screws 27A and 27B into crossbar 28, and then attaching the crossbar to outlet box 29 with outlet box screws 30A and 30B. The second step involves determining the distance that the lighting fixture is to be hung from the outlet box. The third step involves cutting two of the three fixture suspension cables to the appropriate length indicated by the above-determined distance. The fourth step involves determining the slope $\Theta_1$ of the ceiling that the fixture mounting assembly is being installed on. Then, by referring to the Sloped Ceiling Table below, the length "X" illustrated in FIG. 5 is determined for the particular ceiling slope measured.

SLOPED CEILING TABLE

| CEILING SLOPE (degrees) | LENGTH "X" (inches) |
|---|---|
| 10° | 7/32" |

-continued

| SLOPED CEILING TABLE | |
|---|---|
| CEILING SLOPE (degrees) | LENGTH "X" (inches) |
| 15° | 25/32" |
| 20° | 1 1/32" |
| 25° | 1 9/32" |
| 30° | 1½" |
| 35° | 1 23/32" |

Using length "X" obtained from the Sloped Ceiling Table, the third (i.e., longest) fixture suspension cable is cut to a length equal to the length of cables previously cut, plus length "X". For example, for a ceiling slope of 25° and the two cables cut to a length of 50", the third cable would be cut to a length of 50" plus 1 9/32", or 51 9/32".

The fixture cable suspension elements are installed in mounting base 11 by dropping the threaded end of each element down from behind the mounting base, and into respective apertures formed in the mounting base. Then, while each suspension element is manually secured, the corresponding adjusting collar, attached to its suspension cable, is threaded onto the threaded end of the suspension element. Thereafter, with one end of sleeve 24 threaded into bearing structure 22 and the other end of the sleeve threaded onto strain relief bushing 25, the assembled power cord suspension element is dropped down from behind the mounting base, into center aperture 14 of the mounting base. Power cord 8 attached to the luminaire assembly, is then pushed through sleeve 24 and strain relief bushing 25 until the cord is shortened to an appropriate length to match the distance of the luminaire assembly to the inclined ceiling.

At this stage of the installation process, the mounting base and luminaire assembly are both brought up towards the inclined ceiling, and wiring connections are made in accordance with lighting fixture instructions. Thereafter, the mounting base is positioned over mounting screws 27A and 27B so that the two shorter suspension cables 7B and 7C are nearest to the wall and parallel to it as shown in FIG. 5. The mounting base is then secured to the inclined ceiling by threading threaded cap screws 31A and 31B onto mounting screws 27A and 27B, respectively, and tightening them.

At this stage, the luminaire assembly can be perfectly leveled by simply either tightening or loosening adjustment collars 18 as required. Notably, during such adjustments, it may be necessary to hold stationary, pivotable suspension elements 12A, 12B and 12C. The length of power cord 8 below the mounting base, can be adjusted by pushing excess cord up through strain relief bushing 25, into the outlet box. The power cord can then be secured in place by tightening the strain relief bushing.

Figure 6:
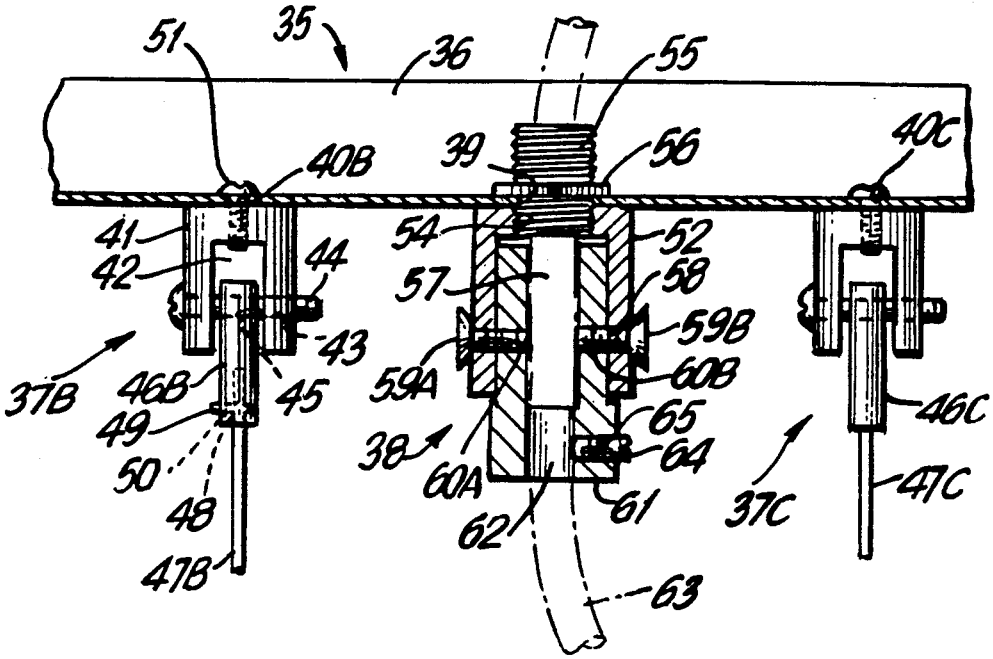
FIG. 6 is a cross-sectional view of the mounting assembly of FIG. 2, taken along line 6—6 thereof.
Figure 7:
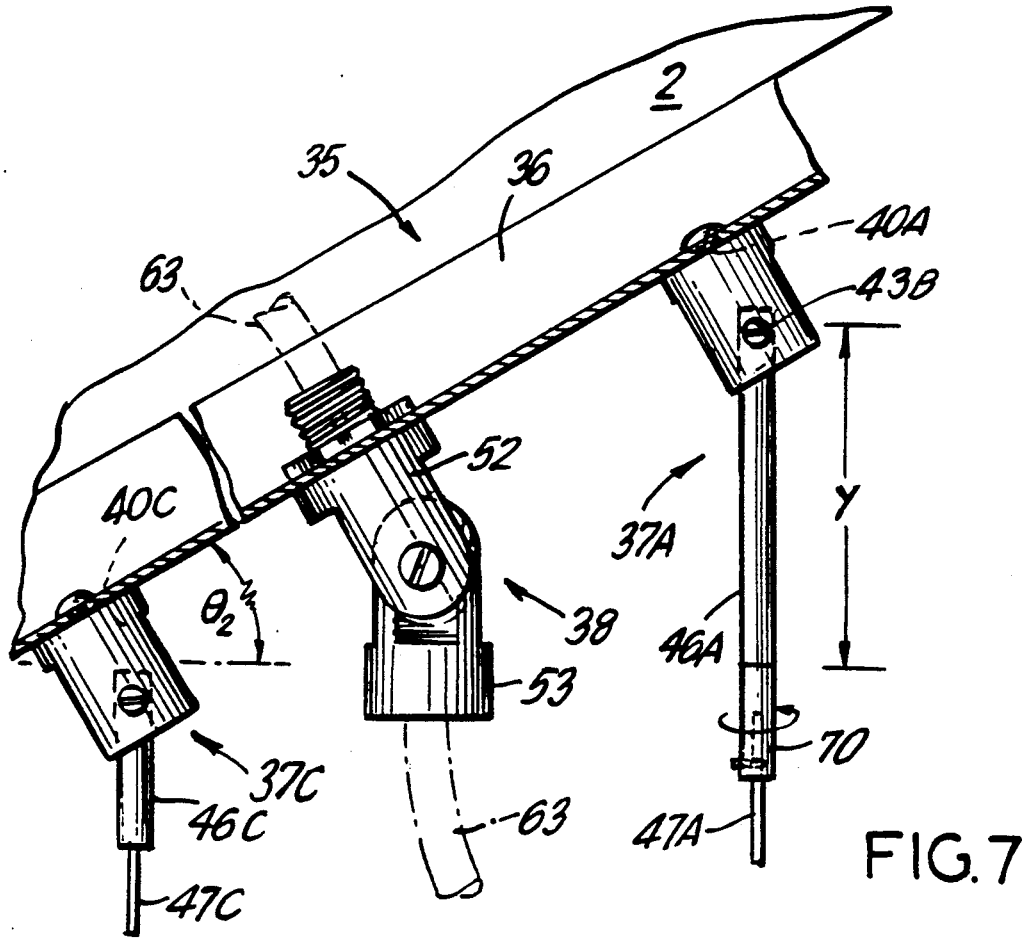
FIG. 7 is an elevated, partially cross-sectional view of the mounting assembly of FIG. 2, taken along line 7—7 thereof.

Referring to FIGS. 6 and 7, the second embodiment of the mounting assembly hereof will now be described.

As illustrated in FIGS. 2 and 6, mounting assembly 35 comprises a mounting base 36, three fixture cable suspension elements 37A, 37B and 37C, and a power cord suspension element 38 operably associated with the mounting base in a manner which will be described in detail below. As with the mounting base of the first embodiment, mounting base 35 is particularly adapted for attachment to a planar structure such as inclined ceiling 2, and includes a centrally formed circular aperture 39 and three circular mounting holes 40A, 40B, and 40C symmetrically spaced about circular aperture 39. As will be hereinafter described, circular aperture 39 functions as a power cord suspension aperture, whereas circular holes 40A through 40C facilitate connection of the fixture cable suspension elements with the mounting base.

As each fixture cable suspension element is identical, a detailed description thereof will be made in reference to fixture cable support element 46B, taking note that similar components in the other support elements 46A and 46C are indicated by like reference numerals.

In FIG. 6, each fixture cable suspension element includes a body portion 41 of generally cylindrical geometry, having a rectangular passageway (i.e. channel) 42 formed through its entire cross-section. In a direction orthogonal to the direction of the rectangular passageway, a bore 43 is formed in the body portion so as to permit installation of a screw 44 through both bore 43 and hole 45 formed in one end of each respective support element 46A, 46B, 46C, as shown. In this way, each support element 46A, 46B, 46C is permitted to freely pivot within channel 42, while a portion of fixture suspension cable 47A, 47B, 47C, respectively, is secured to the opposite end of the support element. To attach the terminal portion of fixture cable 47B, 47C to its respective support element 46B, 46C, the terminal end of the cable is inserted into a longitudinal bore 48 formed in the support element, and a cable securing screw 49 is screwed into 49 threaded transverse bore 50. This arrangement permits releasable engagement and securing of the terminal portion of each fixture suspension cable.

In order to permit rotational adjustment of body portion 41 relative to base portion 36, a screw 51 is passed through the respective mounting hole 40B in mounting base 36 and is received in a threaded bore formed in the base portion of the fixture cable suspension element.

While the length of the lower two support elements 47B and 47C are of equal length, the length of support element 46A is substantially longer to accommodate the distance "Y" indicated in FIG. 7. Notably, this length difference is created by the angle of inclination $\Theta_2$ of the ceiling surface. Preferably, a number of support elements, each of different length, are provided with the mounting assembly of the second embodiment. This will permit the installer to accommodate for variations in distance "Y" from installation to installation. To permit fine adjustment of the overall length of the third support element, an adjustable support element 70 is threaded into a threaded bore formed in the end of support element 46A, opposite transverse bore 43B. The terminal portion of fixture suspension cable 47A, in turn, is secured within a longitudinal bore formed in adjustable support element 70, in a manner similarly described above, or otherwise known in the art.

As illustrated in FIGS. 6 and 7, power cord suspension element 38 comprises a cylindrical body portion 52 and a power cord support element 53. Cylindrical body portion 52 includes a threaded bore 54 formed through its base, through which an externally threaded hollow sleeve 55 is threaded into so that a portion thereof extends through central hole 39. A lock nut 56 is threaded over the projecting portion of sleeve 55 to secure body portion 52 to the mounting base, as shown.

Cylindrical body portion includes a rectangular passageway 57 formed through the entire cross-section thereof. In a direction orthogonal to the direction of the rectangular passageway, a bore 58 is formed so as to permit installation of a pair of screws 59A and 59B through holes 60A and 60B, respectively, formed in the mid-section of support element 61. As shown, support element 61 is provided with central bore 62 to permit passage of power cord 63 up to and through the mounting base. With this arrangement, support element 61 is permitted to freely pivot within channel 57, while power cord 63 passes through central bore 62 and circular aperture 39 in the mounting base. In order to releasably secure the power cord, a power cord securing screw 64 is threaded into a threaded bore 65 formed in the side wall of support element 61.

Installation of the mounting assembly of the second embodiment is achieved in a manner similar to that described above for the first embodiment, with several additional considerations to be kept in mind. Foremost, as the fixture cable support elements permit pivotal movement of the support elements within planes essential parallel to the channel walls of respective cylindrical body portions, each of the three rectangular channels 42 must be in parallel alignment to permit all three fixture cables 47A, 47B and 47C to freely pivot about their respective pivotal axes. Secondly, third fixture cable suspension element 37A having the longest pivotal support element, must be positioned at the highest point of elevation attainable when positioning mounting base over the outlet box, as shown in FIG. 7. With these installation conditions satisfied, the mounting assembly of the second embodiment will provide all of the advantages offered by the first embodiment.

Notably, the fixture suspension members of the illustrated embodiments have been realized using cable. However, the present invention contemplates the use of other elongatable structures such as chain, rod, tube, rope and functionally equivalent structures, which can be cut in the field to an appropriate length as taught herein, to realize the fixture suspension members of the fixture mounting assembly.

Furthermore, the illustrated embodiments of the lighting fixture mounting assemblies hereof have utilized cylindrical geometries for mounting bases 11 and 36 and spherical surfaces for bearing structures 16A and 22. However, it is understood that other geometries can be utilized in carrying out the principles of the present invention.

While the particular embodiments shown and described above have proven to be useful in many applications in the lighting fixture art, further modifications of the present invention herein disclosed will occur to persons skilled in the art to which the present invention pertains. All such modifications are deemed to be within the scope and spirit of the present invention defined by the appended claims.

What is claimed is:

1. A lighting fixture mounting assembly comprising:

a first fixture suspension member for suspending a light fixture having at least one power cord;

a mounting base for attachment to a planar structure disposed relative to a reference plane, and including at least one power cord suspension aperture;

first suspension means having a first bearing surface operably associated with said mounting base and attached to one end of said first fixture suspension member; and power cord suspension means mounted through said at least one power cord suspension aperture and attached to a portion of said at least one power cord, said first suspension means and said power cord suspension means permitting pivotal movement of said first fixture suspension member and said at least one power cord, respectively, relative to said mounting base, and said first suspension means and said power cord suspension means being operable independent of each other, and wherein said first suspension means permits pivotal movement of said first fixture suspension member independent of an angle of inclination formed between said planar structure and said reference plane, and wherein said power cord suspension means permits pivotal movement of said at least one power cord independent of said angle of inclination.

2. The lighting fixture mounting assembly of claim 1, wherein said power cord suspension aperture comprises a circular aperture formed through said mounting base, and wherein said power cord suspension means comprises a bearing structure having an external body portion and a central bore therethrough permitting said at least one power cord to pass through said central bore and be releasably secured within said central bore, said bearing structure further including a spherical surface extending over at least a portion of said external body portion for seating within said circular aperture so as to permit free pivotal movement of said at least one power cord.

3. The lighting fixture mounting assembly of claim 2, wherein said power cord suspension means further comprises power cord length adjustment means operably associated with said bearing structure so as to permit adjustment in the length of said at least one power cord with respect to said reference plane.

4. The lighting fixture mounting assembly of claim 2, which further comprises a second fixture suspension member and a second suspension means having a second bearing surface operably associated with said mounting base and attached to one end of said second fixture suspension member; and further comprises a third fixture suspension member and a third suspension means having a third bearing surface operably associated with said mounting base and attached to one end of said third fixture suspension member.

5. The lighting fixture mounting assembly of claim 4, wherein each of said first, second, and third fixture suspension members comprises an elongated structure selected from the group consisting of cable and rope.

6. The lighting fixture mounting assembly of claim 1, wherein said first suspension means comprises a first body portion having a channel within which a first support element is pivotally mounted and which permits said first fixture suspension member to attach thereto.

7. The lighting fixture mounting assembly of claim 6, wherein said power cord suspension means comprises second body portion having a channel within which a second support element is pivotally mounted, said second support element having a central bore which permits said power cord to pass therethrough and up to an through said at least one power cord suspension aperture, said second support element further including means for releasably securing a portion of said at least one power cord.

8. The lighting fixture mounting assembly of claim 7, wherein said first suspension means further comprises fixture member adjustment means operably associated with said first support element so as to permit adjustment in the height of said at least one fixture suspension member with respect to said reference plane.

9. A lighting fixture mounting assembly comprising:

at least one fixture suspension member for suspending a light fixture having at least one power cord;

a mounting base for attachment to a planar structure disposed relative to a reference plane, and including at least one power cord suspension aperture;

first suspension means being operably associated with said mounting base and attached to one end of said at least one fixture suspension member; and second suspension means mounted through said at least one power cord suspension aperture and attached to a portion of said at least one power cord, said first suspension means and said second suspension means permitting pivotal movement of said at least one fixture suspension member and said at least one power cord, respectively, relative to said mounting base, and said first suspension means and said second suspension means being operable independent of each other, and wherein said mounting base further comprises a fixture member suspension aperture formed as a first circular aperture through said mounting base, wherein said first suspension means permits pivotal movement of said fixture suspension member independent of an angle of inclination formed between said planar structure and said reference plane, and wherein said first supension means comprises a bearing structure having an externally threaded body portion permitting said at least one fixture suspension member to be secured thereto, said bearing structure further including a spherical surface extending over at least a portion of said externally threaded body portion for seating within said first circular aperture so as to permit free pivotal movement of said at least one fixture suspension member relative to said mounting base, and wherein said second suspension means permits pivotal movement of said at least one power cord independent of said angle of inclination.

10. The lighting fixture mounting assembly of claim 9, wherein said first suspension means further comprises fixture member length adjustment means operably associated with said bearing structure so as to permit adjustment in the length of said at least one fixture suspension member with respect to said reference plane.

11. The lighting fixture mounting assembly of claim 9, wherein said at least one fixture suspension, member comprises an elongated structure selected from the group consisting of cable and rope.

* * * * *